US009555996B2

(12) United States Patent
Stauber

(10) Patent No.: US 9,555,996 B2
(45) Date of Patent: Jan. 31, 2017

(54) DEVICE AND METHOD FOR TRIMMING FOLDED PRINTED PRODUCTS

(75) Inventor: Hans Ulrich Stauber, Grut (CH)

(73) Assignee: FERAG AG, Hinwil (CH)

( * ) Notice: Subject to any disclaimer, the term of this patent is extended or adjusted under 35 U.S.C. 154(b) by 894 days.

(21) Appl. No.: 12/403,840

(22) Filed: Mar. 13, 2009

(65) Prior Publication Data

US 2009/0229434 A1 Sep. 17, 2009

(30) Foreign Application Priority Data

Mar. 17, 2008 (CH) ..... 0390/08

(51) Int. Cl.
*B65H 35/00* (2006.01)
*B26D 7/06* (2006.01)
(Continued)

(52) U.S. Cl.
CPC ..... *B65H 35/0006* (2013.01); *B26D 7/0675* (2013.01); *B26D 11/00* (2013.01);
(Continued)

(58) Field of Classification Search
CPC ..... B26D 7/0675; B26D 11/00; B65H 29/40; B65H 35/0006; B65H 2301/44712; B65H 2301/44714; B65H 2701/1932; Y10T 83/0448; Y10T 83/0505; Y10T 83/0524; Y10T 83/2183; Y10T 83/219; Y10T 83/4847; Y10T 83/6476; Y10T 83/6478; Y10T 83/648; Y10T 83/6481; Y10T 83/654; Y10T 83/6542; Y10T 83/6544; Y10T 83/6547; Y10T 83/6555; Y10T 83/6558; Y10T 83/7593; Y10T 83/8791; Y10T 83/9396; Y10T 83/9399; Y10T 83/9401; Y10T 83/9447; Y10T 83/6667; Y10S 83/904; Y10S 83/933; Y10S 83/934
(Continued)

(56) References Cited

U.S. PATENT DOCUMENTS 4,038,893 A * 8/1977 Reist ..... B26D 5/16 83/154
5,113,731 A * 5/1992 Reist ..... 83/35
(Continued)

FOREIGN PATENT DOCUMENTS

EP 0367715 A1 5/1990
EP 0753386 A1 1/1997
EP 1563968 A1 8/2005

*Primary Examiner* — Clark F Dexter
(74) *Attorney, Agent, or Firm* — Rankin, Hill & Clark LLP

(57) ABSTRACT

A method and a device for trimming printed products on the front edges and/or on the lateral edges. The products are inserted into moved receiving compartments along a closed circuit, the compartments being open on at least one side, and include blades moved along in this region, which act together with stationary counter blades. The depth of insertion of the products is restricted by a support such that the front edges of the products are in the direct vicinity of the open side of the compartments, advantageously protruding with their front edges over the moved along blades for the frontal trimming. The edges of the products extending perpendicular to the folded edge are fixed prior to carrying out a trimming by way of a clamping and moving arrangement and only released for the passing on of the printed product.

15 Claims, 7 Drawing Sheets

(51) Int. Cl.
*B26D 11/00* (2006.01)
*B65H 29/40* (2006.01)

(52) U.S. Cl.
CPC ... *B65H 29/40* (2013.01); *B65H 2301/44712* (2013.01); *B65H 2301/44714* (2013.01); *B65H 2701/1932* (2013.01); *Y10S 83/934* (2013.01); *Y10T 83/0448* (2015.04); *Y10T 83/0505* (2015.04); *Y10T 83/0524* (2015.04); *Y10T 83/219* (2015.04); *Y10T 83/2183* (2015.04); *Y10T 83/4847* (2015.04); *Y10T 83/654* (2015.04); *Y10T 83/6547* (2015.04); *Y10T 83/6558* (2015.04); *Y10T 83/6667* (2015.04); *Y10T 83/8791* (2015.04); *Y10T 83/9399* (2015.04); *Y10T 83/9401* (2015.04)

(58) Field of Classification Search
USPC ..... 83/904, 933, 934, 23, 35, 39, 151, 154,83/349, 404, 404.1, 404.2, 404.3, 409, 409.1,83/409.2, 410.7, 411.3, 411.5, 467.1, 592,83/673–675, 694, 733; 198/803.1, 803.9; 270/52.17, 52.18
See application file for complete search history.

(56) References Cited

U.S. PATENT DOCUMENTS

| | | | | |
|---|---|---|---|---|
| 5,501,127 | A * | 3/1996 | Stauber | 83/100 |
| 5,826,476 | A * | 10/1998 | Meier | 83/155 |
| 7,661,665 | B2 * | 2/2010 | Egli | B26D 1/09 270/52.14 |
| 2005/0179189 | A1 * | 8/2005 | Boss | 270/52.17 |
| 2006/0179988 | A1 * | 8/2006 | Mockli et al. | B26D 1/43 83/213 |

* cited by examiner

DEVICE AND METHOD FOR TRIMMING FOLDED PRINTED PRODUCTS

BACKGROUND OF THE INVENTION

Field of the Invention

The invention is in the field of processing of printed products and pertains to a device and a method for trimming of particularly multi-sheet folded printed products, such as newspapers, magazines and brochures.

Description of Related Art

Folded printed products are usually trimmed on the edge opposite the folded edge, as well as on both edges perpendicular to the aforementioned edges. This is termed front trimming or head-foot-trimming respectively.

The device described in EP-A 0753 386 has a plurality of pocket-shaped receiving compartments, which rotate around a common rotation axis and thereby are conveyed along a circular circuit. The receiving compartments are formed by two respective radially orientated supporting surfaces. The products are inserted into the receiving compartments with their folded edges ahead and come to rest against a support, which is in the region of the base of the compartment. The support is shaped and arranged such that the products are completely and deeply positioned in the compartment, i.e. the edge opposite the folded edge is completely within the compartment and clearly distanced from the radially outer, open side of the compartment. In this position, the products are orientated laterally, i.e. in the direction of the rotation axis or in parallel to the compartment base respectively and subsequently clamped with a clamping arrangement directly or indirectly against the supporting surface.

Subsequently, the head-foot-trimming is carried out first, and then the front trimming. For the corresponding trimmings, a respective trimming arrangement is provided, which at least comprises a stationary counter blade as well as blades, which are arranged in the compartments and are moved along with these. The counter blade for the head-foot-trimming is arranged in the movement direction of the compartments prior to the counter blade for the front trimming.

The blades, moved together with the compartments for the head-foot-trimming, are arranged on axially open sides of the receiving compartments, the moved blade for the front trimming is arranged on the open side of the compartments parallel to the compartment base. The stationary counter blades are in suitable positions, in which they may interact with the moved blade in the manner of scissors. As the supporting component or components trimming the front edges need to be led past the counter blade for the head-foot-trimming, the product must be located at different depths in the compartment for the front trimming and the head-foot-trimming. In the known device the product must, thus, already be inserted deeply into the pocket during the reception, in order to be able to carry out the head-foot-trimming.

Prior to the head-foot-trimming the products are fixed in the compartment by the clamping arrangement. After the head-foot-trimming the clamping arrangement is released and the product is laterally gripped by a dislocating arrangement. The dislocating arrangement moves the product along a supporting surface out of the compartment into the position for the front trimming. The clamping arrangement is then activated again and the product is again clamped in the shifted position. After the front trimming, the clamping arrangement is again released and the product is moved through the dislocating arrangement as far out of the compartment as necessary so that it can be taken over by an onward conveyor.

In the known device the products are fed by a gripper conveyor and dropped into the compartments or inserted into them deeply, respectively. Hereby they glide along a supporting surface freely, until their folded edge is stopped at the support. During this process it may occur that the products and/or product parts are dislocated in relation to one another. For the lateral (axial) orientation of the products, before their being clamped, a relatively large distance or period respectively is provided, which corresponds to a movement of the compartments along a circular course over an angle region of e.g. 60°. All the same, it may occur that during the subsequent clamping by the clamping installation the products are not completely orientated, which may lead to impure trimmed edges.

Moreover, the product is only brought into position for the front trimming after the head-foot-trimming and in this position clamped on its front edge by the clamping arrangement. Particularly due to the change between the clamping by the clamping arrangement and by the dislocation installation an arching upwards of the intermediate product region not held by the dislocation installation may have occurred, such that the front edge is not fixed evenly but with folds or dislocations. This may also lead to trimmed edges with reduced edge quality.

An object of the invention is to prevent the disadvantages of the state of the art and to provide a device for trimming of folded printed products as well as a corresponding method, in which the position of the products for achieving an optimum quality trimming is easily controllable.

BRIEF SUMMARY OF THE INVENTION

The device according to the invention includes, like the device described in connection with the state of the art, receiving compartments, which are formed by a supporting surface and are open in the periphery of the supporting surface on at least one, preferably three sides, such that moved along blades can be arranged here and may interact with stationary counter blades. The device further includes a support, which serves as rest or as a stop respectively for the folded edges of the products during or after insertion into the compartments respectively. The device also includes a trimming arrangement for the front trimming of the products and/or a trimming arrangement for the head-foot-trimming, which in each case includes moved along blades, arranged on the respective open sides as well as at least one stationary counter blade. As with the state, of the 'art' a clamping and dislocating arrangement for clamping of the printed products and for dislocation along the supporting surface is provided. The clamping and dislocation arrangement advantageously acts on the lateral edges of the product.

According to the invention, the support is adjusted such that the products, when being taken over, are inserted into the compartments such that the front edge of the printed products opposite the folded edge is in the direct vicinity of the open side of the compartments after insertion into these. Unlike the prior art, the printed product is in particular inserted deeply into the compartment, but the front edge is at a smaller distance from the moved along blade for the front trimming. Advantageously, the front edge protrudes over these moved along blades or is gently moved into this position by being moved along the support. In this position the product, advantageously after alignment in lateral direction (i.e. running in parallel to the compartment base), is fixed by the clamping and dislocation arrangement on the lateral edges running in perpendicular to the folded edge. This happens before the first trimming is carried out. The lateral fixation is only released again, when the printed product is given over, wherein the product, if necessary, is brought, with the clamping and dislocation arrangement, into the effective position for trimming and for the giving over of the product.

The measures, in combination, have the following effect: The product is inserted less deeply into the compartments than according to the state of the art. Hereby, on the one hand, the distance over which the products fall freely is considerably reduced compared with the state of the art. Uncontrolled movements are thus prevented. Within the available time the products can thus be orientated with higher precision because the rough orientation is no longer necessary and can thus be omitted. Alternatively the length of the section of the course of movement, in which the orientation step takes place, may be reduced. Due to the fact that the lateral clamping is carried out directly after the orientation and is not released until the giving over, a formation of creases or a dislocation of the product parts is prevented by gripping and re-releasing. On the other hand the front trimming may be carried out directly after the orientation step without it being necessary for the product to be re-orientated inside the compartment. This results in an overall increased quality of the trimmed edge. For the head-foot-trimming-trimming the product generally needs to be drawn into the compartment, but this happens in an extremely controlled manner by means of the advantageously not released clamping on the lateral edges. Thus, even if a clamping device is used for fixing the front edge and is released after the frontal trimming, this has no influence on the quality of the trimmed edges.

Advantageously, trimming arrangements are provided for the frontal trimming and the head-foot trimming, the stationary counter blades of which may possibly be switched away in the case that the corresponding trimming is not to be carried out. The stationary counter blades are advantageously arranged such that the front trimming is carried out first and then the head-foot-trimming.

For adaptation to different product formats, the support is advantageously movable such that the product overhang beyond the blade for front trimming or the corresponding open side of the compartment, respectively, substantially always has the same width. The support is advantageously formed by one or several stationary elements, which are located in the region of the device, into which the products are inserted and subsequently orientated. Alternatively, the support may be implemented by means of a moved along and advantageously dislocateable compartment base.

The control arrangement for control of the clamping and dislocation arrangement may be designed in the form of a stationary control cam and interacting control elements.

The clamping and dislocation arrangement advantageously includes at least one clamping device with at least two clamping elements, which are able to take up a printed product between them and are movable in relation to one another from an open position to a clamping position by means of a controlling arrangement, e.g. in the form of a stationary control cam and co-operating control elements. In the simplest case, one of the clamping elements may be formed by the supporting surface of the compartment and the other one as a lever rotatable in relation to this surface. It is, however, preferred that the mutually co-operating clamping elements are independent of the supporting surface and, serving as dislocation installation, can be dislocated in relation to it to the compartment base or away from it respectively, in order to bring the product from the position for the front trimming into the position for the head-foot-trimming. The supporting surface may hereby serve as guidance for the corresponding clamping device.

The clamping and moving arrangement includes at least three clamping devices for clamping the frontal edge opposite the folded edge, as well as the lateral edges, which run perpendicularly to the frontal edge, wherein the clamping device for the frontal edge is controllable and movable independently of the clamping devices for the lateral edges.

The axial distance of the clamping devices for clamping the lateral edges is adjustable for adaptation to different formats independently of the position of the clamping device for the front edge.

Advantageously, a first clamping device for clamping the front edge as well as at least two further devices for clamping the lateral edges, running in perpendicular to it, are provided. The first clamping device e.g. acts together with the supporting surface, e.g. with a cross beam integrated in it or fastened to it. It must not, however, be moved along. The further clamping elements advantageously cooperate with counter elements movable in relation to the supporting area. The clamping devices for the front and lateral fixation are advantageously controllable independently from one another, such that the frontal clamping after carrying out of the front trimming may be released and the product may be brought into the position for the head-foot-trimming without it being necessary to release the lateral/side clamping.

BRIEF DESCRIPTION OF THE DRAWINGS

Examples of the invention are shown in the drawings. In purely diagrammatic manner

DETAILED DESCRIPTION OF THE INVENTION

Figure 1:
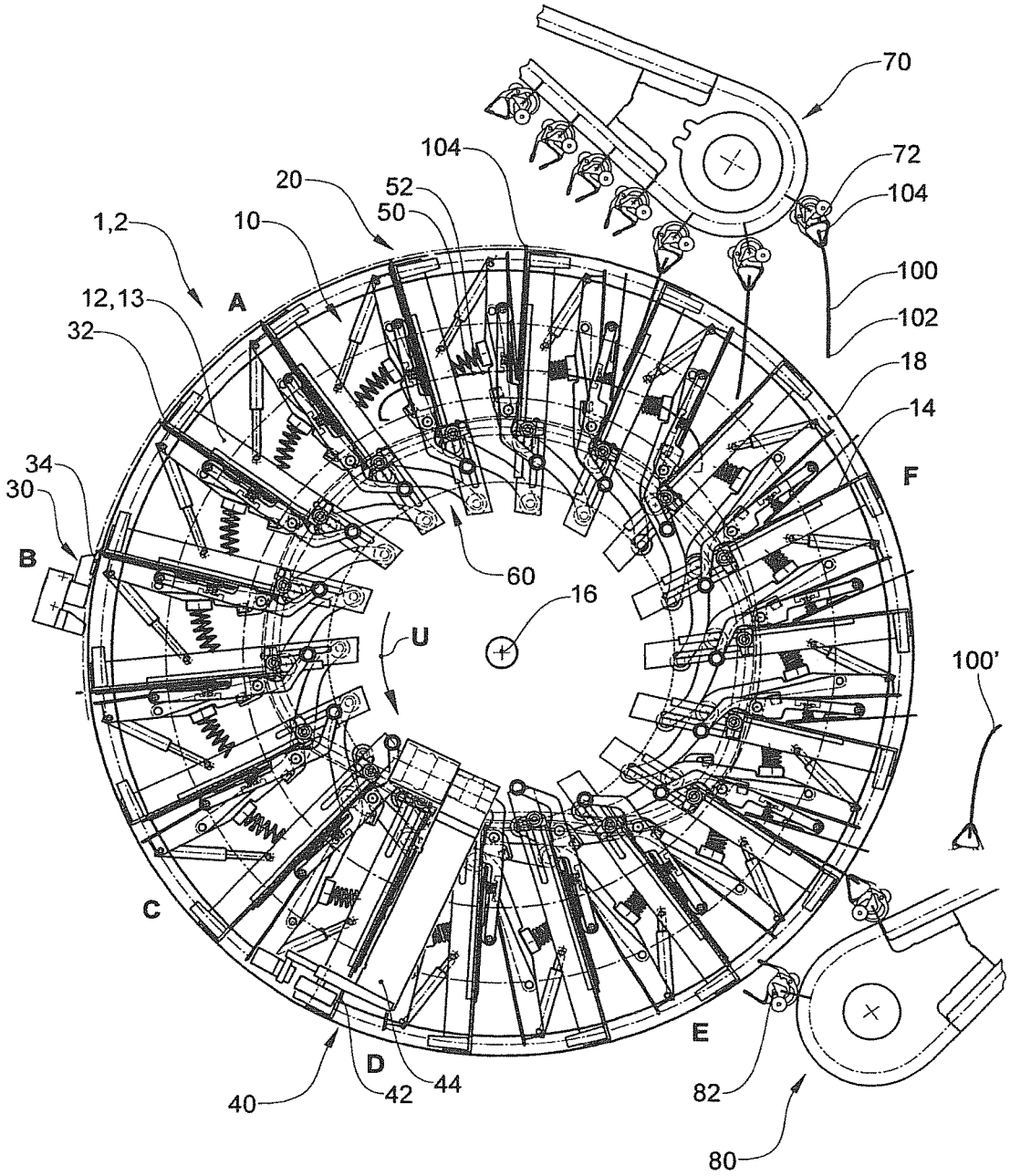
FIG. 1 shows an overall view of the device according to the invention.

FIG. 1 shows the device according to the invention in a view from the side. The setup and functionality generally correspond to the device from publication EP-A 0753 386. Differences exist mainly in the succession of the trimming and in the design of the clamping and dislocation arrangement 20, which is illustrated in more detail in FIGS. 2, 3*a* and *b*. These differences are addressed in the following; in addition reference is made to EP-A 0753 386.

FIGS. 4-7 show details from the overall view and illustrate the individual method steps.

The device 1 comprises a processing drum 2 in a (not shown) frame, which drum is rotatable around its longitudinal axis 16. The processing drum 2 comprises a plurality of receiving compartments 10, which are orientated in a radial direction and are open on both faces of the processing drum 2. The compartments 10 are limited by supporting elements 12, 13, the top sides of which define a supporting surface 14 for the products 100. The compartments 10 are moved along a closed, here circular circuit U.

A traction conveyor 70 in the form of a gripper conveyor with a plurality of grippers 72 arranged above the device 1 serves for the insertion of printed products 100 with their folded edge 102 ahead into the compartments 10 from above. An onward conveyor 80 arranged laterally alongside the device 1 in the lower region, again in the form of a gripper conveyor with a plurality of grippers 82 serves for the take-over of the trimmed products 100' out of the compartments 10 and for their onward conveyance.

The compartments 10 contain, in each case, the clamping and dislocation arrangements 20, with which the products 100 may be fixed in the compartments 10 and moved along the supporting surface 14 substantially perpendicular to the rotation axis 16. The corresponding movements of the clamping and dislocation arrangement 20, are controlled with a control arrangement 60. The clamping and dislocation arrangement 20 is described with reference to FIGS. 2, 3*a* and *b*; the stationary control cams 62, 64, 66 of the control arrangement 60 are easily identifiable in FIGS. 4-7.

A first trimming arrangement 30 serves for carrying the front trimming, i.e. for trimming of the edge 104 of the product 100 opposite the folded edge 102. Edge 104 will also be designated as front edge 104. A first trimming arrangement 30 comprises moved along blade or knife elements 32, arranged in the compartments 10 and orientated in parallel to the rotation axis 16, as well as a stationary counter blade 34. A second trimming arrangement 40 is for making the head-foot-trimming, i.e. for trimming of the lateral edges 106, 108 perpendicular to the folded edge 102. It comprises moved along knife or blade elements 42, arranged in the compartments 10 and which run perpendicular to the rotation axis 16, as well as a stationary blade arrangement with two counter blades 44.

In the upper region of the processing drum 2, a stationary or rest support 50 is located, which defines the compartment base with its upper edge 52 and thus restricts the depth of insertion of the products 100 into the compartments 10. The folded edge 102 of the products 100 abuts against this support 50 directly after the insertion.

Figure 2:
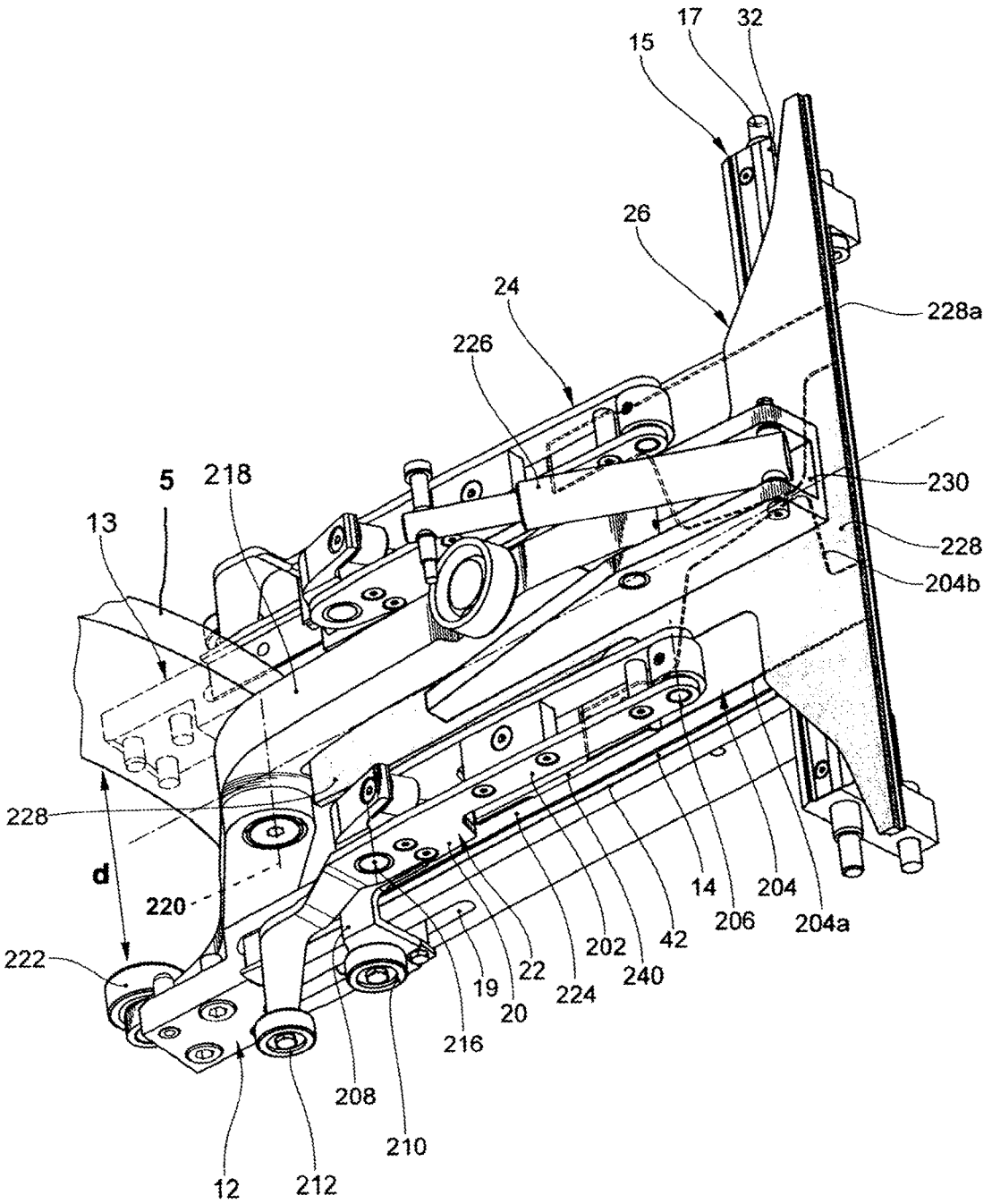
FIG. 2 shows a clamping and dislocation arrangement.

In the following the clamping and dislocating arrangement is described in detail in reference to FIG. 2 and FIGS. 3*a* and 3*b*.

The receiving compartments 10 are defined by the support elements 12, 13, which are radially orientated longish support elements 12, 13, and which are supported on two wheels 18. A first respective support element 12 and a second respective support element 13 define, with their surfaces orientated to compartment 10, the support surface 14, which is a radially orientated support surface 14. The support elements 12, 13 are, on their ends facing rotation axis 16, fixed in the manner of spokes to a respective wheel 3, 4 (indicated diagrammatically in FIG. 3*b*). As described in EP-A 0 753 386, the distance d between the support elements 12, 13 or the wheels 3, 4 respectively can be adjusted in the direction of the longitudinal axis 16 in order to adapt to different product formats. On the radially outer end of the support elements 12, 13 and in parallel to the longitudinal axis 16, a cross beam 15 is located. The cross beam 15 has extensions 17 in the manner of pins with which it is fixed to each wheel 18 (FIG. 1) rotatable around axis 16. The support elements 12, 13 can, for format adaptation, be moved in the direction of the cross beam 15 in relation to it.

On the cross beam 15, the moved along blade elements 32 of the first trimming arrangement 30 are applied; the blades of blade elements 32 are directed outwards in a radial direction. The moved along blade elements 42 of the second trimming arrangement 40 are applied to edges located outwards in an axial direction of the support elements 12. The blades of blade elements 42 face outwards in the axial direction. In the top view on the support surface 14, the blades of the knife elements 42 align with the respective edge of the support elements 12 or the cross beam 15 respectively or protrude over these.

One of the clamping and dislocating arrangements 20 is allocated to each compartment 10. This consists of two clamping devices 22, 24 for the lateral clamping and a clamping device 26 for the frontal clamping. The clamping devices 22, 24 for the lateral clamping are respectively identical in design; in the following, one of the clamping devices is described.

The clamping device 22 for the lateral clamping in each case comprises a lever 202 with which in each case a pressing plate 204, consisting of a plane carrier element 240 and a thin plate 242 made of spring steel, is connected in a manner rotatable around an axis 206 parallel to rotation axis 16. A spring 214 presses the carrier element 240 in its radially inner region 240' away from lever 202. This produces a pressing effect when the clamping device is closed, which first acts on the product regions located near the compartment base, i.e. from the folded edge 102 in the direction of the front edge 104, such that air possibly enclosed in the product is pressed out. The pressing plate 204 has an outer edge 204*a* parallel to the lateral edge of the supporting surface 14 and expands in its radially outer end region 204*b* towards the inside of the supporting surface 14. The clamping device 22 is operatively connected with a carriage 208, which is movable in a slot 19 of the supporting element 12 in radial direction.

The carriage 208 comprises a control element 210 in the form of a control roller. This acts together with a first stationary control cam 62, which is part of the control arrangement 60 for adjustment of the radial position.

The lever 202 is movable in relation to the support element 12 between an open position and a clamping position, in particular pivotable. For this purpose it is fixed to the carriage 208 to be pivotable around an axis 216. On its radially inner end it has a further control element 212, again in the form of a control roller. This element acts together with a second stationary control cam 64 (FIG. 4) for adjustment of the pivot position of the lever 202.

The clamping device 26 for the frontal clamping comprises a further lever 218 which is pivotable around a further axis 220 and is supported on a middle wheel disc 5 arranged between the two above mentioned wheels 3, 4 serving as support for the support elements 12, 13. The middle wheel disc 5 retains its position in a format adaptation, i.e. an axial change of distance of the outer wheels 3, 4 and is not adjusted. The clamping device 26 for the frontal clamping further comprises a pressing plate 228, which is T-shaped in the top view and which is pivotably connected via a longish coupling piece 230 to the lever 218. The radially outer edge 228*a* of the pressing plate 228 runs in parallel to the rotation axis 16, to the blade for frontal trimming and in the present embodiment to the frontal edge of the product to be trimmed. The width of the frontal trimming at least corresponds to the maximal product width. In order for the frontal trimming pressing plate to be able to be moved past the counter blade for the lateral trimming, the product in the present embodiment must be drawn back towards the compartment base.

Figure 3A:
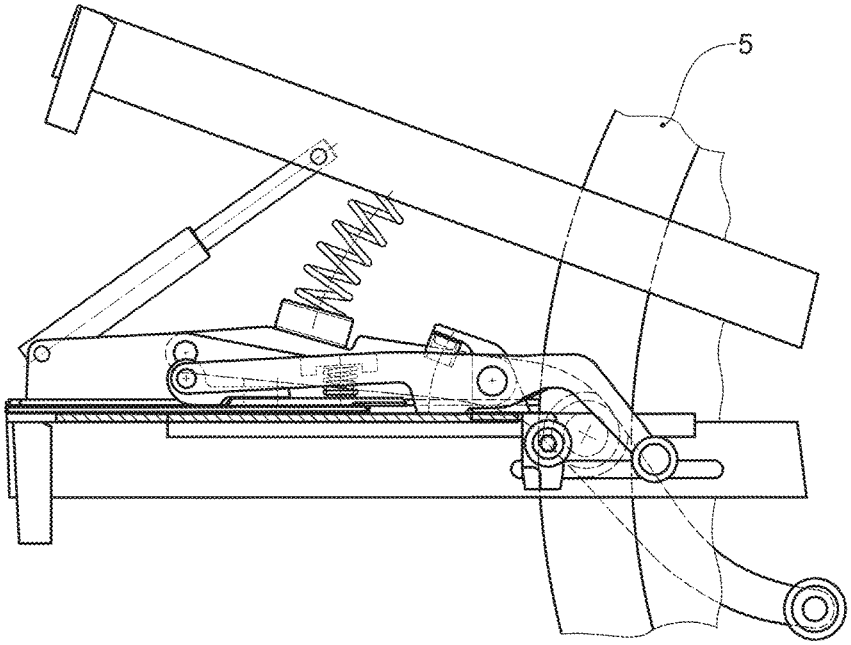
FIG. 3*a* and *b* show clamping and dislocation arrangements in a lateral view in closed, and respectively, open condition.
Figure 3B:
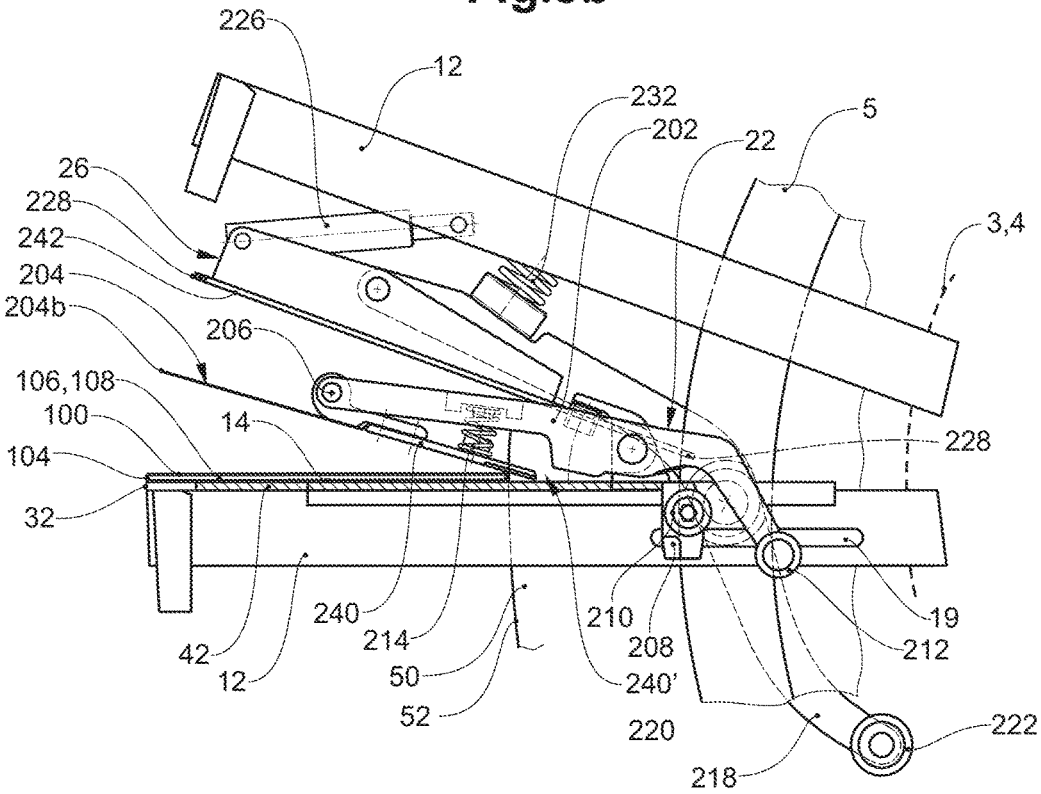

The coupling piece 230 is on the one hand rotatably connected to the lever 218 and on the other hand, on its radially outer end via a telescopic rod 226, with the support element 12, 13 of an adjacent compartment 10 (FIGS. 3*a* and 3*b*). Between the lever 218 and the adjacent compartment 10, a pressure spring 232 is arranged, which presses the lever 218 to the support surface 14. The pivot position of the further lever 218 may be adjusted against the spring effect with a third stationary control cam 66 (FIG. 4), which acts together with a control element (control roller) 222 arranged on the radially inner end of the lever 218. In a closed condition of the lever 218 the frontal trimming pressing plate 228 presses the lateral trimming pressing plate 204 against the support elements 12, 13 or the cross beam 15, respectively.

In the region of the lateral edges of the support elements 12, there is preferably a counter clamping element 224, which acts together with the pressing plate 204 for lateral clamping, is coupled to the carriage 208 and is moved, when the carriage 208 is moved, in a radial direction. Its topside serves as part of the supporting surface 14.

The support 50 consists of one or more plane, stationary elements, each of which is advantageously shaped like the segment of a circle, extends on a plane perpendicular in relation to the rotation axis 16 and engages in-between the support elements 12, 13. They are advantageously movable for format adaptation. Their upper edge 52 is at a constant distance to the blades 32 or the distance decreases along the course of movement. In the latter case the product is at first arranged completely in the compartment and is raised again by the support 50 during the alignment into a position in which the frontal edge protrudes beyond the blade 32. This is a movement, which is preferably small compared to the movement necessary for the lateral trimming.

In the following, the functions of the clamping and movement arrangement 20 are described.

In open condition (FIG. 3*b*) the levers 202 of the lateral clamping devices 22, 24 as well as the lever 218 of the frontal clamping device 26 are in a position pivoted away from the support elements 12, 13. In FIG. 3*b*, the pressing plates 204, 228 are aligned to each other in the view on the rotation axis. A printed product 100 can, thus, be introduced in-between the pressing plate 204 and the supporting surface 14. By moving the lever 218 of the frontal clamping device 26 into a closed position (clamping position) the lever 202 of the lateral clamping devices 22, 24 is also brought into the clamping position. The product is pressed by the pressing plates 204, 228 on its lateral edges and on the front against the supporting surface 14, in particular against the counter clamping elements 224 (lateral edges) and the cross beam 15 (front edge). The outer edges of the pressing plates 204, 228 run in parallel and preferably as close as possible to the product edges to be trimmed. By means of the pivotability of the pressing plate 204 in relation to the lever 202 and the first spring 214, which presses the pressing plate 204 away from the lever 202, a good clamping acting homogeneously over a large area independently of the product thickness is produced and air is pressed out towards the front edge 104. Also, due to the pivotability of the front pressing plate 228 in relation to the lever 218 a good area clamping effect is achieved. A local moving of product parts and, thus, the formation of creases or dents on the clamped product is prevented.

Although the frontal clamping device 26 entrains the lateral clamping devices 22, 24 out of the open position into the closed position, the frontal clamping cannot be opened independent of the lateral clamping to bring the products 100 into the position for the lateral trimming after the frontal trimming, i.e. to move them towards rotation axis 16. By means of the spring 232 in-between the frontal clamping lever 218 and the adjacent support element 12, 13 differing product thicknesses may be compensated. In particular, it is prevented that too large forces act on the mechanical control cams and these components get jammed. The levers serve as rocker arms. The control cams need only bring about the counter force necessary for closing or opening respectively. The lateral clamping devices 22, 24 are supported, as mentioned above, on separate wheel discs 3, 4 and are controllable independently of one another, but are, however, moved together synchronically in parallel to the supporting surface 14 in operation. The frontal clamping device 26 is supported independently on the middle wheel disc 5 and is neither moved in a radial direction nor for format adaptation.

The function of the complete device 1 is described in reference to FIG. 1 and additionally FIG. 4 to 7.

Figure 4:
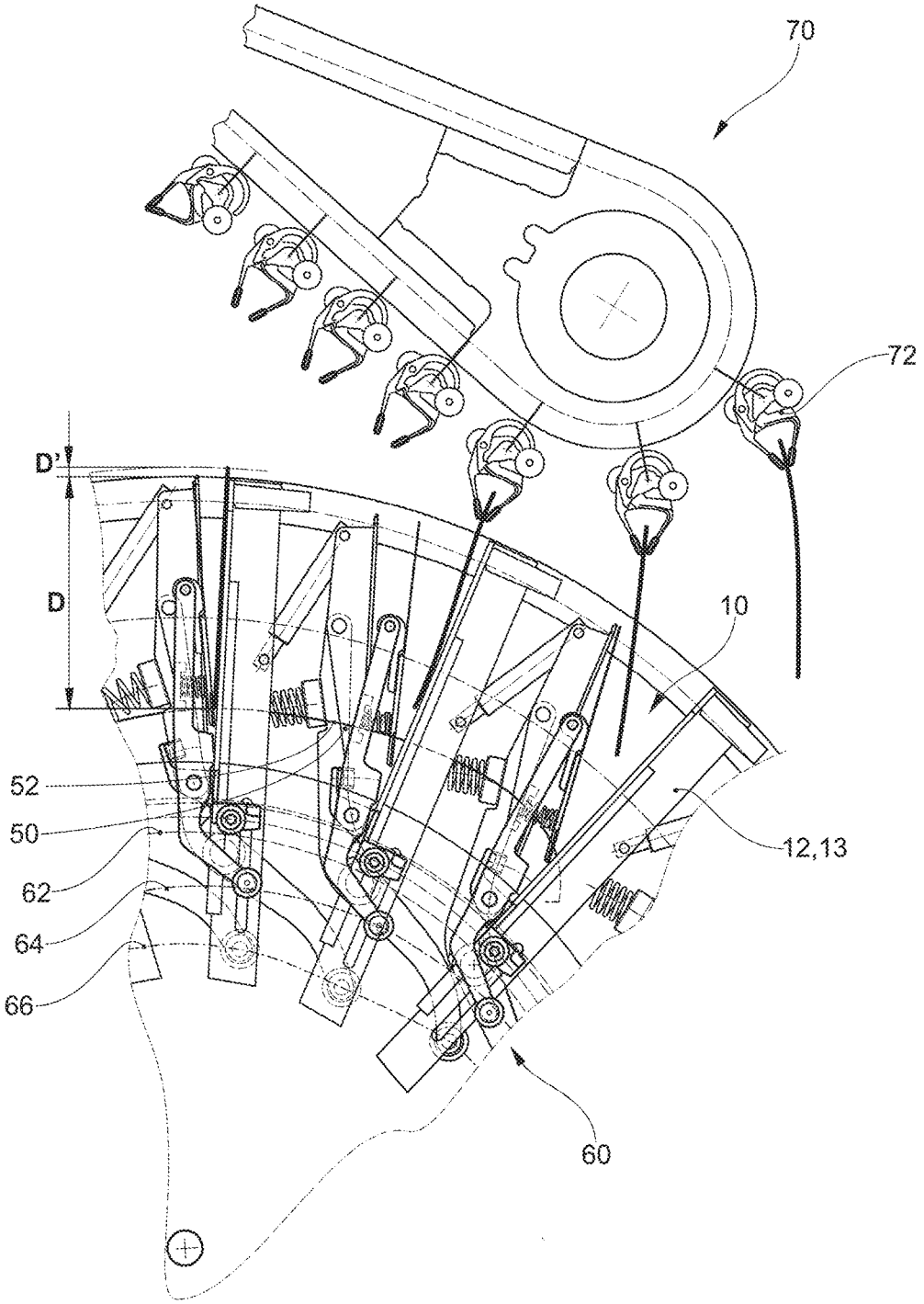
FIG. 4 shows a detailed view of the take-over region of the device in FIG. 1.

As shown in FIG. 1 and FIG. 4, the products 100 are introduced in a taking over region with their folded edges 102 moved by the grippers 72 of the feeder 70 into the compartments 10 and introduced in-between the support surface 14 and the open clamping elements 22, 24, 26. In order to achieve an opening as large as possible the pressing plates 204, 218 are initially in a mutually aligned position (middle product 100 still held by the gripper 72 in FIG. 4). Subsequently the lateral clamping devices 22, 24 and then the front clamping device 26 are approximated to the support surface 14. Simultaneously the gripper 72 is opened and the product 100 is released.

In the taking over region, the stationary support 50 includes the upper side 52 against which the folded edge 102 comes to lie. The support 50 is shaped and positioned such that its upper edge 52 has a predetermined distance D to the blades of the radially outer front trimming blade elements 32. This distance is adjusted such that it is smaller than the product length in an insertion direction (radial direction). Herewith, the inserted product 100 released by the gripper 72 protrudes over the blade of blade element 32 by a predetermined value D'. Thus it is already in the position in which the frontal trimming can be carried out.

After insertion, the clamping devices 22, 24, 26 are approximated so far by a corresponding shaping of the control cams 64, 66 responsible for the opening/closing so that the product is positioned, seen in a circuit direction, largely in parallel to the support surface 14. The product 100, however, may be shifted in parallel to it. In the region A of the circuit, which extends over an angle region of approximately 60°, the product 100 is, by orientation elements not shown here (e.g. laterally arranged orientation tapes), orientated in the direction of the rotation axis 16. At the end of region A it is clamped by complete closing of the clamping devices 22, 24, 26 against the support surface 14 or in the lateral region respectively against the movable counter clamping element 224 (FIG. 5 topmost and second to topmost compartment 10).

Figure 5:
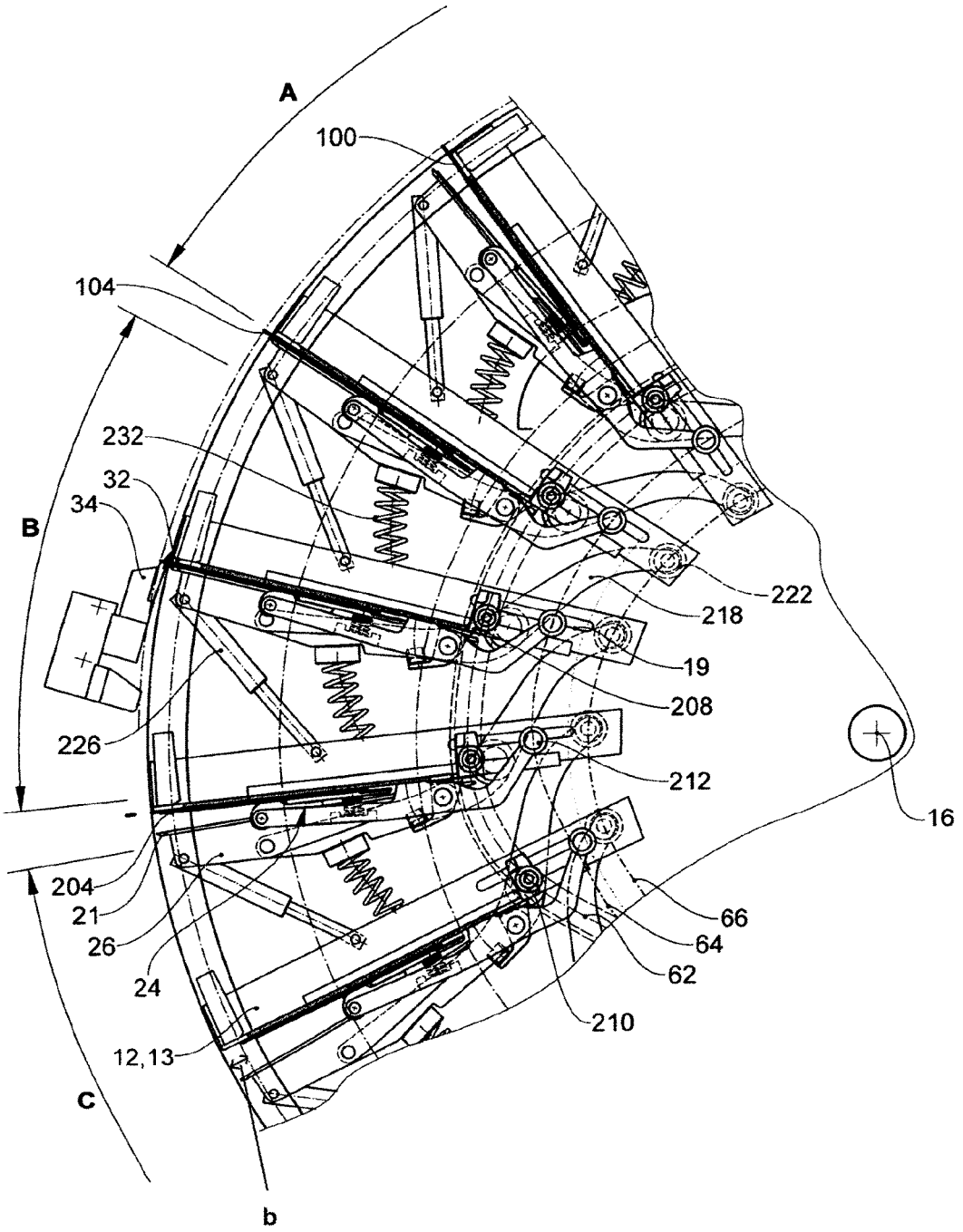
FIG. 5 shows a detailed view of the region of the device in FIG. 1, in which the front trimming is carried out.

The region B follows, in which the stationary counter blade 34 is positioned and in which the frontal trimming is carried out. This region B extends over an angle region of approximately 30° (FIG. 5).

In the following region C, the frontal clamping device 26 is released and the product 100 is re-released at frontal edge 104 (lower compartment in FIG. 5). The carriage 208 is now, in the closed condition of the clamping devices 22, 24, moved inward by a predetermined value (travel) b, which is not dependent on the product. The movement mechanism is, independently of the product format, always identically configured and travels by the same value b. The carriage 208 moves the lever 202 and the pressing plate 204 as well as the counter clamping element 224 in\-wards. The lateral clamping is hereby not released. The product 100, thus, remains well positioned over its whole area. The region extends over an angle region of approximately 50°.

Figure 6:
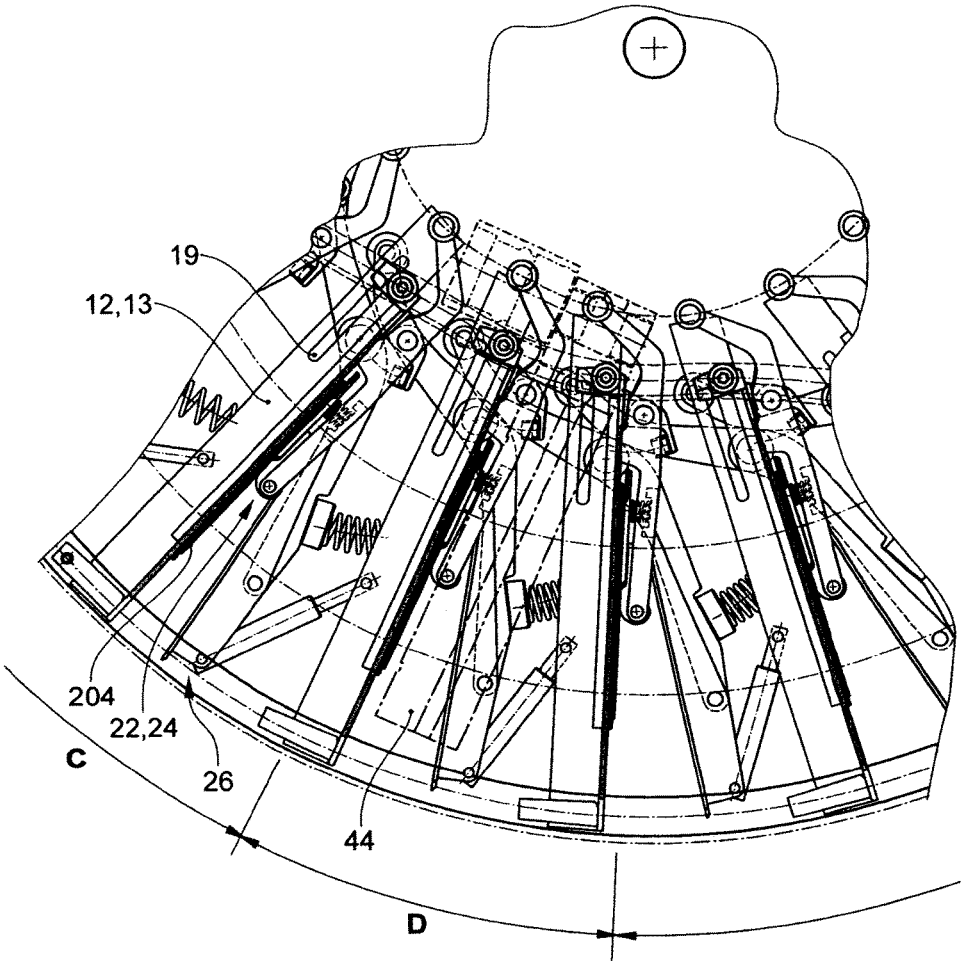
FIG. 6 shows a detailed view of the region of the device in FIG. 1, in which the head-foot-trimming is carried out.

In the following region D (approx. 20°) the stationary counter blades 44 for the head-foot trimming are arranged such that the two lateral edges are trimmed simultaneously and in the same trimming direction (FIG. 6). For spatial reasons the radially outer ends of the counter blade 44 are inside the course of the moved blades 32 for the frontal trimming. Thus, it is necessary to move the products 100 inwards already before the head-foot-trimming (region C).

Figure 7:
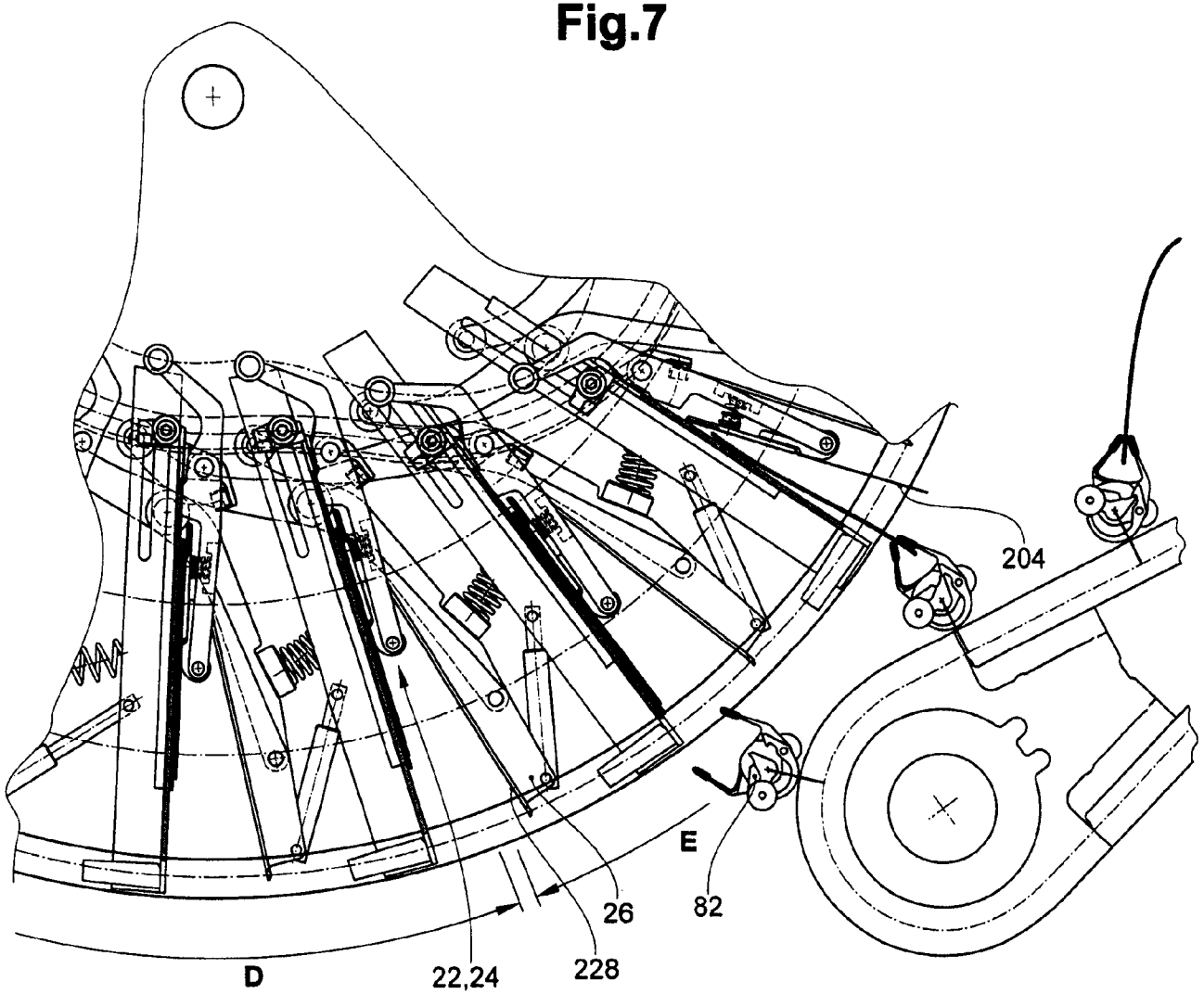
FIG. 7 shows a detailed view of the giving-over region of the device in FIG. 1.

In subsequence to the head-foot-trimming the product with the clamping and moving arrangement 20 is moved outwards again into a position in which the frontal edge 104 protrudes beyond the frontal trimming blade 32, e.g. by 30 mm and can be gripped by the grippers 82 (FIG. 7). The corresponding region E extends over an angle region of approximately 40°. At the end of the region E the clamping devices 22, 24 are opened for the lateral clamping, when the product 100 has already been gripped by the grippers 82. The transfer is, thus, carried out in a very controlled manner.

In the region F, in-between conveying away and feeding the carriage 208, the clamping and moving arrangement 20 is moved inwards again fractionally, such that these may take their initial positions again in region A.

The invention has the advantage that it is not necessary to insert the product 100 completely into the compartments, when being given over by the feeder, i.e., the conveyor 70. Thus the product 100 is, directly after the giving over, in the right radial position for the frontal trimming, which is carried in direct subsequence to the orientation process. Thus, there is more time for orientation in Region A, such that it can be more precise. Furthermore, the product 100 is securely fixed after the orientation until it is given over to the onward conveyor 80 by the lateral clamping elements 22, 24 that may also be moved in a radial direction. The front edge 104 of the product 100 is preferably pressed against the support element 12 at first and then released after the frontal trimming has been carried out, in order for the product to be moved inwards. It is not necessary to clamp the product anew.

The device 1 shown in the figures merely shows a preferred embodiment of the invention. Within the concept of the invention further variants are possible; e.g. the product may be inserted into the compartments 10, not with its folded edge 102 first, but also in different manner. In this case the three edges of the product are trimmed, which are not the downstream edge. In case only a frontal or head-foot-trimming respectively is desired, the stationary blades 44 for the head-foot-trimming or the frontal trimming respectively can be brought into an inactive position. Besides, it is not compelling for the compartments to be implemented by means of a processing drum; they may also be formed by pockets, which are moved in succession along a closed circuit at fixed or variable distances. Instead of a stationary support, a support which is moved along, may be provided, e.g. an adjustable compartment base.

The frontal clamping by the frontal clamping device 26 is basically not compelling, but leads to an improved quality of trimmed edge. For frontal and lateral clamping, the pressing plate 228 for frontal clamping may not necessarily overlap the pressing plates 204 for the lateral clamping; the pressing plates may be arranged side by side. An overlap, however, has advantages in the implementation of a pressing area, which lies in a common plane. Besides, it is possible for the frontal clamping devices 26 to be movable together with the lateral clamping devices 22, 24.

The invention claimed is:

1. A device for trimming a folded printed product on at least two edges, the device comprising:

a plurality of receiving compartments, each receiving compartment is for being associated with and adapted to receive one folded printed product to be trimmed and comprising at least one supporting surface, wherein the compartments are drivable to circulate along a circuit in a circulation direction;

a stationary rest support on which a folded edge of the folded printed product inserted into an associated passing one of the receiving compartments is to be received, wherein each of the receiving compartments is open at least on a first side opposite a compartment base which corresponds to a region of the rest support for inserting the folded printed product into the associated receiving compartment in an insertion direction, and wherein the rest support is positioned for receiving the printed product such that a frontal edge of the folded printed product opposite the folded edge is, after insertion into the associated receiving compartment, in the direct vicinity of the first side of the compartment;

a first trimming arrangement for a frontal trimming of the folded printed product comprising a plurality of moveable blades, which are moveable along with the receiving compartments, as well as at least one stationary counter blade;

a second trimming arrangement for a lateral trimming of the folded printed product comprising a movable blade arranged in each of the receiving compartments and a stationary counter blade;

a controllable clamping and moving arrangement associated with each receiving compartment for clamping the folded printed product and for moving the folded printed product along the supporting surface, the clamping and moving arrangement comprises a first clamping device for clamping the frontal edge of the folded printed product for frontal trimming, and a second clamping device with at least two clamping elements for clamping at least one lateral edge of the folded printed product extending perpendicular to the folded edge and parallel to the insertion direction for lateral trimming, wherein the at least two clamping elements of the second clamping device cooperate with one another such that they are able to take the folded printed product between them, and a control arrangement for moving the at least two clamping elements relative to one another between an open position and a clamping position;

wherein the second clamping device is operatively connected with a carriage, which is movable in a radial direction, so that the at least two clamping elements of the second clamping device can be dislocated toward the rest support or away from the rest support and independent of the supporting surface such that the folded printed products are clamped by the clamping elements of the second clamping device and hence fixed before carrying out the lateral trimming and remain clamped by the clamping elements of the second clamping device while being dislocated between a trimming position for the frontal trimming and a further trimming position for the lateral trimming, the clamping elements of the second clamping device only being released for transfer of the folded printed products after the frontal and lateral trimming.

2. The device according to claim 1, wherein the moveable blades of the first trimming arrangement each are arranged on the open first side of a respective one of the compartments, and wherein the rest support is positioned such and the clamping and moving arrangement is controllable such that the printed products, before being clamped by the clamping and moving arrangement, protrude over the moveable blades of the first trimming arrangement.

3. The device according to claim 2, wherein the rest support is adjustable such that the distance between the rest support and the moveable blades of the first trimming arrangement is adaptable to the format of the printed products to be trimmed.

4. The device according to claim 1, wherein the compartments are open on the first side as well as on two second sides running perpendicularly thereto, wherein each of the moveable blades of the first trimming arrangement are respectively arranged on the open first side of each of the compartments, and each of the moveable blades of the second trimming arrangement are respectively arranged on one of the second sides of each of the compartments, and the at least one stationary counter blade of the first trimming arrangement is arranged in a circulation direction ahead of the counter blade of the second trimming arrangement, such that the frontal trimming is carried out before the lateral trimming.

5. The device according claim 4, wherein the clamping and moving arrangement is controllable such that the printed products are moveable away from the movable blade in-between the frontal trimming and the lateral trimming.

6. The device according to claim 1, wherein the first clamping device for clamping the frontal edge is controllable and movable independently of the second clamping device for clamping the at least one lateral edge.

7. The device according to claim 6, wherein a distance between the first clamping element and the second clamping element of the second clamping device is adjustable for adaptation to different formats independently of the position of the first clamping device.

8. The device according to claim 1, wherein the receiving compartments are drivable around a common axis and extend in a radial direction away from the axis, and wherein the first side is a radially outer side and second sides extend perpendicular to the first side.

9. A method for trimming folded printed products on at least one edge, comprising the steps of:

providing a device according to claim 1;

driving the receiving compartments to circulate along the circuit;

introducing one of the printed products into the associated compartment, such that the folded edge of the printed product is received on the rest support in the region of the compartment base and such that the frontal edge of the printed product opposite the folded edge is in the direct vicinity of the open first side;

clamping the printed product with the clamping and moving arrangement, and thereby clamping lateral edges of the printed product that extend perpendicularly to the folded edges;

moving the printed product with the clamping and moving arrangement along the supporting surface;

trimming the printed product with the first trimming arrangement;

completely releasing the printed product only for the purpose of transferring the printed product after completion of the trimming.

10. The method according to claim 9, comprising the further step of trimming the folded edge of the printed product and supporting the printed product by the rest support, such that, before being clamped by the clamping and moving arrangement, the printed product protrudes over the respective moveable blade of the first trimming arrangement.

11. The method according to claim 9, further comprising the step of frontal trimming by trimming the frontal edge of the printed product and then head-foot-trimming by trimming the printed product on the lateral edges extending perpendicularly to the frontal edge.

12. The method according to claim 11, further comprising the step of clamping the printed product in a region of the frontal edge and on the lateral edges after insertion into the associated receiving compartment.

13. The method according to claim 12, further comprising the step of releasing the frontal edge after carrying out the frontal trimming while the lateral edges are held in clamped condition.

14. The method according to claim 13, further comprising the step of moving the printed product towards the compartment base after release of the frontal edge without the two lateral edges being released and subsequently carrying out the head-foot-trimming.

15. The method according to claim 14, further comprising the step of moving the printed product away from the compartment base after carrying out the head-foot-trimming, such that the printed product may be transferred to an onward conveying device.

* * * * *